United States Patent [19]

Easton et al.

[11] Patent Number: 4,888,107

[45] Date of Patent: Dec. 19, 1989

[54] DE-EMULSIFICATION OF OILS

[75] Inventors: Thomas Easton; Bryan Thomas, both of Barry, Wales

[73] Assignee: Dow Corning Limited, Barry, Wales

[21] Appl. No.: 149,294

[22] Filed: Jan. 28, 1988

[30] Foreign Application Priority Data

Feb. 14, 1987 [GB] United Kingdom ..... 8703492

[51] Int. Cl.[4] ..... C10G 33/04

[52] U.S. Cl. ..... 208/188; 208/187; 252/358; 210/708

[58] Field of Search ..... 252/194, 312, 313, 329, 252/358; 106/2; 208/187, 188; 210/705, 708, 710, 723

[56] References Cited

U.S. PATENT DOCUMENTS

| | | | |
|---|---|---|---|
| 4,374,734 | 2/1983 | Meucombe | 208/188 |
| 4,457,371 | 7/1984 | McCoy et al. | 208/188 |
| 4,501,911 | 2/1985 | Koerner et al. | 208/188 X |

FOREIGN PATENT DOCUMENTS

| | | | |
|---|---|---|---|
| 0141585 | 5/1985 | European Pat. Off. . | |
| 2250920 | 5/1974 | Fed. Rep. of Germany | 208/188 |
| 1281108 | 7/1972 | United Kingdom . | |
| 1360398 | 7/1974 | United Kingdom . | |

*Primary Examiner*—Glenn Caldarola
*Attorney, Agent, or Firm*—Alexander Weitz

[57] ABSTRACT

The specification describes and claims a method for the de-emulsification of emulsions of water and crude oil which comprises treating the emulsion with an organosiloxane, a siloxane unit having a quaternary ammonium group $R'N^+(R^2)_3X^-$ linked to its silicon atom, R' represents a divalent hydrocarbon group linking the silicon and nitrogen atoms, each $R^2$ represents an alkyl group having up to 20 carbon atoms or a polyoxyalkylene chain having 3 to 50 oxyalkylene groups, and $X^-$ represents a halogen ion. Examples of organosiloxanes given include those composed exclusively of the said units, and copolymers composed of these siloxane units and siloxane units according to the general formula $R_b(SiO_{4-b})/2$ in which each R is a substituted or unsubstituted hydrocarbon group of up to 10 carbon atoms, and b has the value 0. 1, 2 or 3, for example those according to the average general formula $$R_3SiO(R_2SiO)_x(RZSiO)_ySiR_3 \quad \text{(iv)}$$

in which x has a value in the range 1 to 150, y has a value in the range 1 to 10 and the ratio of (X+y)/y lies in the range 2 to 25.

10 Claims, No Drawings

DE-EMULSIFICATION OF OILS

This invention is concerned with de-emulsification of oils and is particularly concerned with breaking emulsions encountered in the recovery and processing of crude oil from oil wells.

As recovered from an oil well, crude oil may be, and often is, in the form of an emulsion of oil and water. These emulsions vary in constitution from well to well and indeed as between the emulsions yielded by individual wells over a period of time. These emulsions may contain, for example up to 80% water, and are frequently extremely stable due to the presence in the emulsion of a variety of emulsifiers for example asphaltenes. The presence of water in the crude oil is undesirable for a variety of reasons and it has been the practice to remove as much of the water as possible by use of one or more organic deemulsifier substances. Generally, the water content of the crude oil is thus reduced to about 1% or less. By this process the salt content of the crude oil is also reduced but may, nevertheless, remain unacceptably high. If the salinity is too high, it is a practice to subject the crude oil to a de-salting process in which the crude oil is washed with water. This process may be carried out at the oil well, or in a refinery. In order to achieve a desired low level of salt and water in the crude oil passed to the next stage of processing, it is a practice to employ a de-emulsifying agent, heat, and often, electrostatic separation techniques.

The most appropriate substance or blend of substances for use as de-emulsifier for a particular crude oil is generally selected by observing the effectiveness in breaking the emulsion of substances previously known to be effective as de-emulsifiers for other crude oils. Organic substances proposed for use as de-emulsifiers include, for example, sulphonates, polyglycol ethers, oxylated phenols, e.g. nonyl phenol ethoxylate, and alkanolamine derivatives.

Proposals have been made to use certain silicone substances instead of the organic substances generally used in practice to de-emulsify crude oils. For example, it has been proposed to use in a Kuwait crude oil an organosiloxane compound of the formula $$((CH_3)_3SiOSi(CH_3)_2(CH_2)_3)_2N^+(CH_3)_2I^-$$

Of the silicone substances, the polysiloxane polyoxyalkylene oxide copolymers are regarded as the most effective de-emulsifiers for crude oil. The use of such copolymers to de-stabilize crude oil emulsions is referred to, for example, in European Patent Specification No.141 585 and G.B. Patent Specifications Nos. 1 281 108 and 1 360 398.

Despite the many substances proposed as de-emulsifiers for crude oil it remains difficult or impossible in practice to de-emulsify some crude oils as desired, particularly those which contain very little water.

An object of this invention is to provide materials capable of use in small amounts in de-emulsification of at least some of those crude oil emulsions which have heretofore proved more resistant to de-emulsification, and to enhance the range of materials for de-emulsification of crude oil emulsions.

We have now found that certain organosiloxanes having at least one siloxane unit which has a trialkyl quaternary ammonium group associated with its silicon atom are operative in de-emulsification of certain crude oils.

The present invention provides in one of its aspects a method for the de-emulsification of emulsions of water and crude oil which comprises treating the emulsion with an organosiloxane having in the molecule at least one quaternary ammonium substituted siloxane unit of the general formula $$R_aZSiO_{\frac{3-a}{2}} \quad \text{(i)}$$

in which a has the value 1 or 2, each R represents an oleophylic substituted or unsubstituted hydrocarbon group of up to 10 carbon atoms provided that one of the R's may be a hydroxyl group when a has the value 2, Z represents a quaternary ammonium group $$R'N^+(R^2)_3X^- \quad \text{(ii)}$$

linked to the silicon atom of the siloxane unit, R′ represents a divalent hydrocarbon group linking the silicon and nitrogen atoms, each $R^2$ represents an alkyl group having up to 20 carbon atoms or a polyoxyalkylene chain having from 3 to 50 oxyalkylene groups and $X^-$ represents a halogen ion.

The effectiveness of any one of the selected quaternary ammonium organosiloxanes as a de-emulsifier for a crude oil emulsion varies from oil to oil and appears to depend on characteristics of the oily and aqueous phases and also upon the temperature at which the de-emulsification is carried out. Its effectiveness under field operating conditions is not readily predictable, but may be ascertained by a simple testing procedure in conventional manner. Thus, samples of the organosiloxanes may be mixed with the emulsion, the mixture shaken and the time measured during which a required proportion of the water is separated or the proportion of water separated in a given time measured. Whilst not wishing to be bound by any particular theory, we believe the effectiveness of these materials as de-emulsifiers derives from a number of factors including, for example, the ability of the organosiloxane to permit at least some of its oleophilic substituents to be present in the oily phase of the emulsion whilst its quaternary ammonium groups are present in the aqueous phase, thus to disturb the existing emulsifier system sufficiently for de-emulsification to occur.

The organosiloxanes used in a method according to the invention may be linear, branched or crosslinked fluids, gums or resins having any desired number of siloxane units provided the organosiloxane has a desired balance of oleophilic and hydrophilic properties. Preferably the organosiloxane has 2 to 2000 silicon atoms. The organosiloxane may be composed exclusively of units (i), or composed of units (i) and other siloxane units having from one to four siloxane linkages per silicon atom. We prefer that the organosiloxane is a polydiorganosiloxane composed of siloxane units (i) and siloxane units according to the general formula $$R_bSiO_{\frac{(4-b)}{2}} \quad \text{(iii)}$$

in which b has the value 0, 1, 2 or 3 and each R is an oleophilic substituted or unsubstituted hydrocarbon group of up to 10 carbon atoms provided that R may be a hydroxyl group when b is greater than 1. The units (iii) may thus be present as chain units, chain branching units or terminal units of the organosiloxane molecule and the units (i) may be present as chain units or as terminal units. The group R of units (i) and (iii) is preferably an unsubstituted alkyl, aryl, alkaryl, aralkyl or cycloaliphatic group. The most preferred groups are the lower alkyl groups, for example methyl, ethyl and propyl and the phenyl group. Preferably not less than 80% of the groups R are methyl.

In units of formula (i), the group R' linking the silicon and nitrogen atoms is a divalent hydrocarbon group. Suitable groups include the aliphatic hydrocarbon groups and the arylaliphatic hydrocarbon groups, for example, those of the formulae

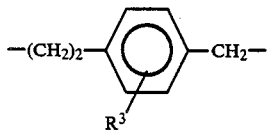

and

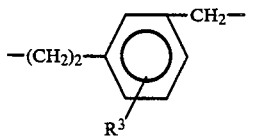

where $R^3$ represents a hydrogen atom or a hydrocarbon group having up to twenty carbon atoms, and the alkylene groups according to the formula $—(CHR^4)_n—$ where n has a value in the range 2 to 10 and $R^4$ represents a hydrogen atom or a methyl group.

In units of formula (i), the groups $R^2$ may be the same or different, and may be an alkyl group having up to 20 carbon atoms or a group of the formula $—(CH_2CHR^4O)_tH$ where $R^4$ is as aforesaid and is preferably H throughout, and t has a value from 3 to 50. Suitably, at least one of the $R^2$ groups is an alkyl group. For example, two of the groups $R^2$ may have 1 to 5 carbon atoms, for example the methyl or ethyl groups, and one of the groups $R^2$ may have a chain of 10 to 15 carbon atoms.

In units of formula (i), the halogen ion $X^-$ may be any of those commonly available, for example, iodide or chloride.

Among suitable organosiloxanes are the linear polydiorganosiloxanes according to the average general formula $$R_3SiO(R_2SiO)_x(RZSiO)_ySiR_3 \quad \text{(iv)}$$

in which R and Z are as defined above, x has a value in the range 1 to 150 and y has a value in the range 1 to 10. In preferred materials the ratio of (x+y/y) lies in the range 2 to 25. More preferably, the sum of x+y lies in the range 2 to 20: the ratio of (x+y/y) lies in the range 2 to 10. Most preferably, y has the value 1 or 2; the ratio of (x+y/y) lies in the range 2 to 5.

Quaternary ammonium salts of organosiloxanes are known materials. Organosiloxanes suitable for use in the present invention may be made by methods known in the art. For example they may be prepared from the corresponding tertiary amine and halogenated polysiloxane. Haloalkyl polydiorganosiloxanes may be prepared by hydrosylilation reaction between a hydrosiloxane and a halogenated unsaturated organic material, or by copolymerisation of the corresponding dialkoxy haloalkyl silane with a polydiorganosiloxane. Quaternary ammonium polysiloxanes also may be made by hydrolysis of the corresponding dialkoxy alkyl quaternary ammonium silane, or by hydrolysis of the alkoxy haloalkyl silane and subsequent treatment with the required trialkyl amine. We prefer to prepare the appropriate iodoalkyl substituted polydiorganosiloxane and then bring about reaction of this with the appropriate trialkyl amine.

In a method according to the invention, the organosiloxane may be incorporated into the crude oil in any convenient way, e.g. via a metering device, and may be introduced in undiluted or diluted condition, for example as a solution in organic solvent, for example hexan-1-ol. The amount of the organosiloxane introduced may be determined on a trial basis, but normally is not more than about 500 parts de-emulsifier per million parts of the emulsion by volume. The organopolysiloxane may be introduced as sole de-emulsifier or may be introduced in conjunction with other materials, for example, organic de-emulsifiers of known type.

By use of a method according to the invention we have been able to de-emulsify some crude oils to a comparable or greater extent than was possible using conventional materials. The selected polysiloxanes are operative in the de-emulsification of crude oils emerging from the well and in the de-emulsification of aqueous emulsions present during desalting of the crude oil. Benefits of the invention are particularly apparent with the more stable crude oils, with crude oils which contain very little water and with crude oils treated at lower temperatures.

In order that the invention may become more clear there now follows a description of examples illustrative of the invention. In the examples all parts are by volume unless otherwise stated. The symbol Me represents the methyl group.

The performance as de-emulsifiers for crude oil of various quaternary ammonium salts of organosiloxanes was compared with the performances of organic de-emulsifiers for crude oil and with the performances of example polysiloxane polyoxyalkylene copolymers. The comparisons were made using 100 ml portions of the crude oils. The portions were charged into clear glass containers and a desired amount of the subject de-emulsifier added. In Examples 1 to 5, the containers were shaken vigorously on a laboratory scale shaker for five minutes, allowed to stand for ten minutes and then shaken gently to allow water droplets in the mixture to coalesce. In Example 6 the oil and water were mixed in a mixer for one minute whilst 6% water was added to the crude oil and for a further 30 seconds after addition of the water had been completed. The samples were maintained at the desired temperature. The amount of separated water was recorded at intervals.

Each of the illustrative organosiloxanes had at least one quaternary ammonium substituted siloxane unit according to the general formula $$R_aZSiO_{\frac{3-a}{2}} \quad \text{(i)}$$

in which a has the value 1 or 2, R represents Me, Z represents a quaternary ammonium group $$R'N^+(R^2)_3X^- \quad \text{(ii)}$$

linked to the silicon atom of the siloxane unit, R' represents the group—$(CH_2)_3$— or the group —$CH_2)_3$—$C_6H_4$—$CH_2$— linking the silicon and nitrogen atoms, each $R^2$ represents an alkyl group having up to 20 carbon atoms and $X^-$ represents a halide ion. Illustrative organosiloxanes 1 to 8 and 12 were polyorganosiloxanes according to the general formula $$Me_3SiO(Me_2SiO)_x(MeSiO\text{-}Z)_ySiMe_3 \quad \text{(iv)}$$

in which R' is —$(CH_2)_3$—, two groups $R^2$ are methyl and one is an alkyl group having 12 to 14 carbon atoms. Illustrative organosiloxane 9 was a polyorganosiloxane according to the general formula (v) in which R' is —$(CH_2)_3$—, all three groups $R^2$ are ethyl, X is iodide, x is 6, y is 2 and the ratio (x+y/y) is 4. Illustrative organosiloxane 13 had the same R and $R^2$ groups as organosiloxanes 1 to 8, and a group R' of the formula —$(CH_2)_2$—$C_6H_4$—$CH_2$—. These illustrative organosiloxanes had the following characteristics:

| Illustrative organosiloxane | x | y | (x + y) / y | $X^-$ |
|---|---|---|---|---|
| First | 71 | 4 | 18.75 | chloride |
| Second | 47.5 | 2.5 | 20 | chloride |
| Third | 6 | 2 | 4 | iodide |
| Fourth | 1 | 1 | 2 | iodide |
| Fifth | 19 | 1 | 20 | iodide |
| Sixth | 18 | 2 | 10 | iodide |
| Seventh | 45 | 5 | 10 | iodide |
| Eighth | 17 | 3 | 6.7 | iodide |
| Ninth | 6 | 2 | 4 | iodide |
| Twelfth | 5 | 5 | 2 | iodide |
| Thirteenth | 3 | 5 | 1.6 | iodide |

Tenth and eleventh illustrative organosiloxanes were hydrolysates of dimethoxy silanes and consisted principally of a mixture of linear and cyclic polysiloxanes having siloxane units according to the general formula $$(MeZSiO)_y, \quad \text{(vi)}$$

terminal units of the linear polysiloxanes being according to the general formula $$Me(OH)ZSiO_{\frac{1}{2}}, \quad \text{(vi)}$$

in which units (vi) and (vii) Z is as defined above, i.e. $R'N^+(R^2)_3X^-$, R' is —$(CH_2)_3$—, two groups $R^2$ are methyl and one is an alkyl group having 12 to 14 carbon atoms and y has an average value of about 7. In the tenth illustrative organosiloxane $X^-$ is chloride and in the eleventh illustrative organosiloxane $X^-$ *is iodide.*

Illustrative organosiloxane 14 was a liquid resinous material derived from a resin (having a number average molecular weight of about 800 formed from trimethylsiloxy, dimethyl hydrosiloxy and quatrosiloxy units in a molar ratio of 7:2:5) by hydrosilylation reaction of the resin with chloro α methylstyrene in presence of platinum catalyst followed by addition to the purified reaction product of the tertiary trialkyl amine $Me_2NT$ in which T is an alkyl chain having 12 to 16 carbon atoms.

Comparative material A was an organic de-emulsifier as used in 1986 for de-emulsification of crude oil from the Shell Sirikit field in Thailand.

Comparative material B was an organic de-emulsifier composition comprising a mixture of polyglycol resins, non-ionic surfactant, alcohol and higher boiling hydrocarbons recommended in 1986 for de-emulsification of crude oil from the Valhall field in the North Sea.

Comparative material C was a polydiorganosiloxane polyoxyethylene glycol block copolymer comprising a center block of about 15 dimethylsiloxane units and two hydroxyl terminated polyoxyethylene oxypropyl dimethyl silyl end blocks.

Comparative material D was a trimethylsilyl end blocked polydiorganosiloxane polyoxyethylene glycol copolymer having on average about 14 dimethylsiloxane units and two hydroxyl terminated polyoxyethylene oxypropyl methyl siloxane units.

Comparative material E was a polyorganosiloxane having quaternary ammonium groups according to the general formula $$Me_3SiO(Me_2SiO)_x(MeSiOR'N^+(R^2)_3X^-)_ySiMe_3$$

in which x was 18, y was 2, R' was —$(CH_2)_3$—, two groups $R^2$ were ethyl and one group $R^2$ was a group $CH_2CH_2OH$ and $X^-$ was iodide.

Comparative material F was an organic de-emulsifier composition comprising a mixture of polyglycol resins, non-ionic surfactant, alcohol and higher boiling hydrocarbons recommended in 1986 for de-emulsification of crude oil from the Statfjord field in the North Sea similar to comparative material B but comprising the materials in different proportions.

Comparative material G was an organic de-emulsifier as used in 1987 for separation of water from crude oil in the desalting process during which the oil/water mixture is heated.

EXAMPLE 1

A sample of crude oil from the Mobil Statfjord field containing 40% water by volume was divided into 100 ml portions, and the performance of various materials as de-emulsifiers examined as aforesaid. The materials were used in volumes of 60 parts to 1,000,000 parts crude oil. The test was carried out at room temperature. The volume of water separated from the oil after 15 minutes, 60 minutes and 24 hours was recorded. The results are recited in Table 1. From this Table it can be seen that under the test conditions the illustrative organosiloxanes all performed satisfactorily in comparison with the comparative material. Results over the one hour period are best when using the second illustrative composition, whereas over the 24 hour period the performance of the tenth illustrative composition was substantially better than that of comparative composition C.

TABLE 1

| Composition | ml Water Separated From 100 ml Portion in | | |
|---|---|---|---|
| | 15 minutes | 60 minutes | 24 hours |
| Illustrative | | | |
| First | 0 | 12.5 | 25 |
| Second | 11.5 | 25 | 26.5 |
| Tenth | 5 | 14 | 36.5 |
| Comparative C | 6.5 | 21.5 | 27.5 |
| None | 0 | 0 | 0 |

EXAMPLE 2

A sample of crude oil from the Shell Sirikit field in Thailand contained 18% wax and 1.5% water and was solid at room temperature. The emulsion was particularly stable. The crude oil was divided into 100 ml portions and the performance of the third and fourth illustrative organosiloxanes and comparative material A as de-emulsifiers examined. The materials were used in volumes of 400 parts to 1,000,000 parts crude oil. The test was carried out at 70° C. The volume of water separated from the oil after 10, 20, 40 and 80 minutes was recorded. The percentage by volume of water remaining in the top layer of the oil phase (Q%) was also recorded, the balance of water remaining in a layer of emulsion between the oil and aqueous phases. The results are recited in Table 2. From this Table it can be seen that under the test conditions, the third and fourth illustrative organosiloxanes were more effective than the comparative material.

A similar test was carried out at 80° C. using a sample of crude oil from the Shell Sirikit field in Thailand containing 18% waxy solids at room temperature and 1.4% water. The performance of the third illustrative organosiloxane and comparative material C was examined. 400 ppm of the materials were used. The results are also shown in Table 2. The performance of the third illustrative organosiloxane was markedly better than that of the comparative material C.

TABLE 2

| Composition | ml Water Separated From 100 ml Portion in | | | | |
|---|---|---|---|---|---|
| | 10 min | 20 min | 40 min | 80 min | Q % |
| (70° C.) | | | | | |
| Illustrative | | | | | |
| Third | 0.3 | 0.35 | 0.4 | 0.4 | 0 |
| Comparative A (70° C.) | 0 | 0 | 0 | 0.1 | 0.8 |
| Illustrative | | | | | |

TABLE 2-continued

| Composition | ml Water Separated From 100 ml Portion in | | | | |
|---|---|---|---|---|---|
| | 10 min | 20 min | 40 min | 80 min | Q % |
| Fourth | 0.025 | 0.05 | 0.1 | 0.2 | 1.4 |
| Comparative A (80° C.) | 0 | 0 | 0.05 | 0.1 | 1.2 |
| Illustrative | | | | | |
| Third | 0.35 | 0.35 | 0.4 | 0.4 | 0 |
| Comparative C | 0 | 0 | 0 | 0 | 1 |
| None | 0 | 0 | 0 | 0 | 1.4 |

EXAMPLE 3

A sample of crude oil from the Valhall field in the North Sea contained 10% water. The emulsion was particularly stable. The crude oil was divided into 100 ml portions and the performance of various materials as de-emulsifiers examined. The materials were used in volumes of 10 parts to 1,000,000 parts crude oil. The test was carried out at 70° C. The volume of water separated from the oil after 10, 20 and 30 minutes was recorded. The results are recited in Table 3. From this Table it can be seen that under the test conditions comparative material B performed substantially better than comparative material C. The third illustrative organosiloxane was more effective than comparative material C but less effective than comparative material B, whereas the combination of the third illustrative organosiloxane with an equal volume of comparative material B was most effective.

TABLE 3

| Composition | ml Water Separated From 100 ml Portion in | | |
|---|---|---|---|
| | 10 min | 20 min | 30 min |
| None | 0 | 0 | 0 |
| Illustrative Third | 1.3 | 1.6 | 1.8 |
| Comparative B | 1.8 | 2.3 | 2.7 |
| Equal Volumes of Illustrative Third and Comparative B | 2.4 | 3.3 | 3.9 |
| Comparative B | 1.4 | 2.2 | 2.6 |

EXAMPLE 4

A sample of crude oil from the Mobil Statfjord field containing 40% water by volume was divided into 100 ml portions and the performance of various materials as de-emulsifiers examined. The materials were used in volumes of 60 parts to 1,000,000 parts crude oil. The test was carried out at room temperature and repeated at 40 and 60° C. The proportion of the water separated from the oil after 5, 15 and 30 minutes was recorded. The results are recited in Tables 4, 5 and 6. As can be seen from these Tables the illustrative organosiloxanes demonstrate varying degrees of effectiveness as de-emulsifiers, the particular benefits to be achieved being temperature dependent. Thus at room temperature the third, sixth, seventh, tenth and eleventh illustrative organosiloxanes each performed better than any of the comparative materials. At 40° C., only the third and eighth illustrative organosiloxanes performed comparably to comparative material F, whereas the sixth, seventh, ninth and tenth also performed better than comparative material D. At 60° C., none of the illustrative organosiloxanes performed as well as comparative material F, although the performance of the third, sixth, seventh, eighth and tenth illustrative organosiloxanes was comparable with that of comparative material D. Under all the test conditions the performance of the comparative material E was substantially poorer than that of the other materials.

TABLE 4

| Composition | | Room Temperature Test ml Water Separated From 100 ml Portion in 5 min | 15 min | 30 min |
|---|---|---|---|---|
| Illustrative | | | | |
| Third | | 24 | 34 | 35 |
| Fifth | | 0 | 0 | 9 |
| Sixth | | 6 | 29 | 31 |
| Seventh | | 10 | 21 | 31 |
| Eighth | | 0 | 6 | 10 |
| Ninth | | 0 | 6 | 15 |
| Tenth | | 10 | 25 | 38 |
| Eleventh | | 15 | 22 | 29 |
| Comparative | D | 8 | 25 | 28 |
| | E | 0 | 0 | 0 |
| | F | 9 | 10 | 12 |
| None | | 0 | 0 | 0 |

TABLE 5

| Composition | | 40° C. Centigrade Test ml Water Separated From 100 ml Portion in 5 min | 15 min | 30 min |
|---|---|---|---|---|
| Illustrative | | | | |
| Third | | 30 | 38 | 38 |
| Fifth | | 10 | 21 | 22 |
| Sixth | | 15 | 34 | 34 |
| Seventh | | 12 | 32 | 34 |
| Eighth | | 21 | 38 | 38 |
| Ninth | | 4 | 21 | 35 |
| Tenth | | 18 | 34 | 34 |
| Eleventh | | 16 | 22 | 25 |
| Comparative | D | 31 | 32 | 32 |
| | E | 0 | 5 | 6 |
| | F | 19 | 36 | 38 |
| None | | 0 | 0 | 1.2 |

TABLE 6

| Composition | | 60° C. Centigrade Test ml Water Separated From 100 ml Portion in 5 min | 15 min | 30 min |
|---|---|---|---|---|
| Illustrative | | | | |
| Third | | 36 | 38 | 38 |
| Fifth | | 18 | 24 | 28 |
| Sixth | | 34 | 38 | 38 |
| Seventh | | 34 | 36 | 38 |
| Eighth | | 34 | 36 | 38 |
| Ninth | | 21 | 25 | 28 |
| Tenth | | 35 | 35 | 36 |
| Eleventh | | 20 | 25 | 30 |
| Comparative | D | 36 | 38 | 38 |
| | E | 8 | 12 | 16 |
| | F | 40 | 40 | 40 |
| None | | 0 | 10 | 15 |

EXAMPLE 5

A sample of crude oil from the Mobil Statfjord field containing 20% water by volume was divided into 100 ml portions and the performance of various materials as de-emulsifiers examined. The materials were used in volumes of 60 parts to 1,000,000 parts crude oil. The test was carried out at room temperature. The proportion of the water separated from the oil after 5, 30 and 60 minutes was recorded. The results are recited in Table 7. From this Table it can be seen that the third and fourth illustrative organosiloxanes performed better than either of the comparative materials D and F.

TABLE 7

| Composition | | Room Temperature Test ml Water Separated From 100 ml Portion in 5 min | 30 min | 60 min |
|---|---|---|---|---|
| Illustrative | | | | |
| Third | | 0 | 16 | 16 |
| Fourth | | 0 | 17 | 19 |
| Comparative | D | 0 | 11 | 15 |
| | F | 2 | 4 | 5 |
| None | | 0 | 0 | 0 |

EXAMPLE 6

Emulsions were prepared from a blend of de-emulsified crude oils from the North Sea Ninian, Maureen and Statfjord fields containing less than 1% water. 6% tap water was added to the crude oil over a one minute period whilst mixing vigorously and mixing continued for 30 seconds. The emulsions were treated with selected materials in two series. The emulsions for each series were formed by dividing the prepared emulsions into 100 ml portions and the selected treating agents added in volumes of 2 parts to 1,000,000 parts emulsion. The tests were carried out at 60° C. The proportion of the water separated from the oil after 5, 10, 20 and 30 minutes was recorded. The results for the two series are recited in Tables 8 and 9. From these Tables it can be seen that the illustrative organosiloxanes tested performed better than the comparative material G.

TABLE 8

| Composition | ml Water Separated From 100 ml Portion in 5 min | 10 min | 20 min | 30 min |
|---|---|---|---|---|
| None | 0 | 0.1 | 0.25 | 0.5 |
| Comparative G | 1.7 | 2.2 | 4.3 | 4.3 |
| Illustrative | | | | |
| Third | 2.2 | 2.3 | 4.3 | 4.3 |
| Twelfth | 2.5 | 3.0 | 4.2 | 5.0 |

TABLE 9

| Composition | ml Water Separated From 100 ml Portion in 5 min | 10 min | 20 min | 30 min |
|---|---|---|---|---|
| None | 0.1 | 0.1 | 0.25 | 0.5 |
| Comparative G | 2.6 | 3.0 | 3.7 | 4.0 |
| Illustrative | | | | |
| Tenth | 4.0 | 4.0 | 4.5 | 4.5 |
| Thirteenth | 3.0 | 3.5 | 4.0 | 4.3 |

That which is claimed is:

1. A method for the de-emulsification of emulsions of water and crude oil which comprises treating the emulsion with an organosiloxane having in the molecule at least one quaternary ammonium substituted siloxane unit of the general formula, $$R_aZSiO_{\frac{3-a}{2}} \quad \text{(i)}$$

in which a has the value 1 or 2, each R represents an oleophylic substituted or unsubstituted hydrocarbon group of up to 10 carbon atoms provided that one of the R's may be a hydroxyl group when a has the value 2, Z represents a quaternary ammonium group $$R'N^+(R^2)_3X^- \quad \text{(ii)}$$

linked to the silicon atom of the siloxane unit, R' represents a divalent hydrocarbon group linking the silicon and nitrogen atoms, each $R^2$ represents an alkyl group having up to 20 carbon atoms or a polyoxyalkylene chain having 3 to 50 oxyalkylene groups and $X^-$ represents a halogen ion.

2. A method according to claim 1 wherein the organosiloxane is composed exclusively of units (i).

3. A method according to claim 1 wherein the organosiloxane is a polydiorganosiloxane composed of siloxane units (i) and siloxane units according to the general formula $$R_bSiO_{\frac{(4-b)}{2}} \quad \text{(iii)}$$

in which each R is a substituted or unsubstituted hydrocarbon group of up to 10 carbon atoms and b has the value 0, 1, 2 or 3 provided that R may be a hydroxyl group when b is greater than 1.

4. A method according to claim 3 wherein the organosiloxane is a polydiorganosiloxane according to the average general formula $$R_3SiO(R_2SiO)_x(RZSiO)_ySiR_3 \quad \text{(iv)}$$

in which x has a value in the range 1 to 150, y has a value in the range 1 to 10 and the ratio of x+y/y lies in the range 2 to 25.

5. A method according to claim 3 wherein at least 80% of the groups R are methyl.

6. A method according to claim 1 wherein the group R' is an alkylene group according to the formula $-(CHR^4)_n-$ where n has a value in the range 2 to 10 and $R^4$ represents a hydrogen atom or a methyl group.

7. A method according claim 1 wherein each of the groups $R^2$ is a alkyl group having up to 20 carbon atoms.

8. A method according to claim 7 wherein two of the groups $R^2$ have 1 to 5 carbon atoms and one of the groups $R^2$ has a chain of 10 to 20 carbon atoms.

9. A method according to claim 1 wherein at least one of the group $R^2$ is of the formula $-(CH_2CHR^4O)_tH$ where $R^4$ represents a hydrogen atom or a group $CH_3$ and t has a value from 3 to 50, any remaining groups $R^2$ being alkyl groups having up to 20 carbon atoms.

10. A method according to claim 1 wherein the halogen ion $X^-$ is an iodide or chloride ion.

* * * * *